United States Patent [19]

Scungio et al.

[11] Patent Number: 4,939,913

[45] Date of Patent: Jul. 10, 1990

[54] ORNAMENTAL WATCH ACCESSORY

[76] Inventors: Roger V. Scungio, 15 Roger Rd., Johnston, R.I. 02919; Melodie A. Betters, 302 Lake Dr., Chepachet, R.I. 02814

[21] Appl. No.: 354,120

[22] Filed: May 19, 1989

[51] Int. Cl.[5] ..... A44C 25/00

[52] U.S. Cl. ..... 63/21; 63/2; 368/285

[58] Field of Search ..... 63/2, 21, 29.1; 368/285, 286; 224/170–173, 164–166; 24/459, 17 B, 482; 40/323

[56] References Cited

U.S. PATENT DOCUMENTS

| | | | |
|---|---|---|---|
| 354,666 | 12/1886 | Stufft | 368/286 |
| 2,605,604 | 8/1952 | Lavigna | 368/285 |
| 2,815,640 | 12/1957 | Kirshner | 368/285 |
| 4,353,124 | 10/1982 | Weinzettel et al. | 63/29.1 X |
| 4,399,910 | 8/1983 | Gutentag | 40/323 X |
| 4,757,662 | 7/1988 | Gasser | 24/459 X |
| 4,837,756 | 6/1989 | Hartman et al. | 368/286 |

FOREIGN PATENT DOCUMENTS

| | | | |
|---|---|---|---|
| 13791 | 8/1980 | European Pat. Off. | 63/29.1 |
| 1166771 | 11/1958 | France | 63/2 |
| 11730 | of 1915 | United Kingdom | 224/170 |

*Primary Examiner*—James R. Brittain

*Attorney, Agent, or Firm*—Salter & Michaelson

[57] ABSTRACT

A readily attachable and detachable ornament for watches and the like comprising an ornamental member adapted to be positioned on top of the watch housing and having an opening therein through which the watch face is visible, said ornamental member having means for releasably securing same to said watch housing so that the watch face and the opening in the ornamental member are in alignment.

10 Claims, 2 Drawing Sheets

ORNAMENTAL WATCH ACCESSORY

BACKGROUND AND SUMMARY OF THE INVENTION

The present invention relates generally to the jewelry art, and is more particularly concerned with the provision of an ornamental accessory for wristwatches and the like. Although watches, in addition to their functional utility as a time telling device, are also considered to be a fashion item, the ornamentation for watches heretofore has largely been integrated into the watch face or has been provided as a permanent attachment to the watch housing such as by gluing or cementing. It has therefore been found desirable to provide ornamentation that may be readily attached and detached with respect to a wristwatch, whereby a watch that is devoid of ornamentation may be readily modified to become an item of costume jewelry, in addition to functioning as a time telling device. By providing an ornamental accessory that may easily be attached and detached with respect to a conventional watch, without the necessity of utilizing any special tools or equipment, the watch owner may own several of the ornamental accessories contemplated by the present invention, whereby any desired accessory may be assembled with the watch to complement jewelry and/or apparel being worn by the user.

It is therefore an object of the present invention to provide an ornamental accessory for watches and the like that can be quickly and easily mounted on the watch, and removed therefrom, without the necessity of utilizing any special tools or equipment.

Another object is the provision of an ornamental accessory that permits a wrist watch to be easily converted into an item of costume jewelry, without in any way affecting the time telling function of the watch.

Still another object is the provision of an ornamental watch accessory that is simple and economically feasible to manufacture, and which when assembled with a watch, gives the appearance of being a permanent part thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED FORM OF THE INVENTION

Figure 1:
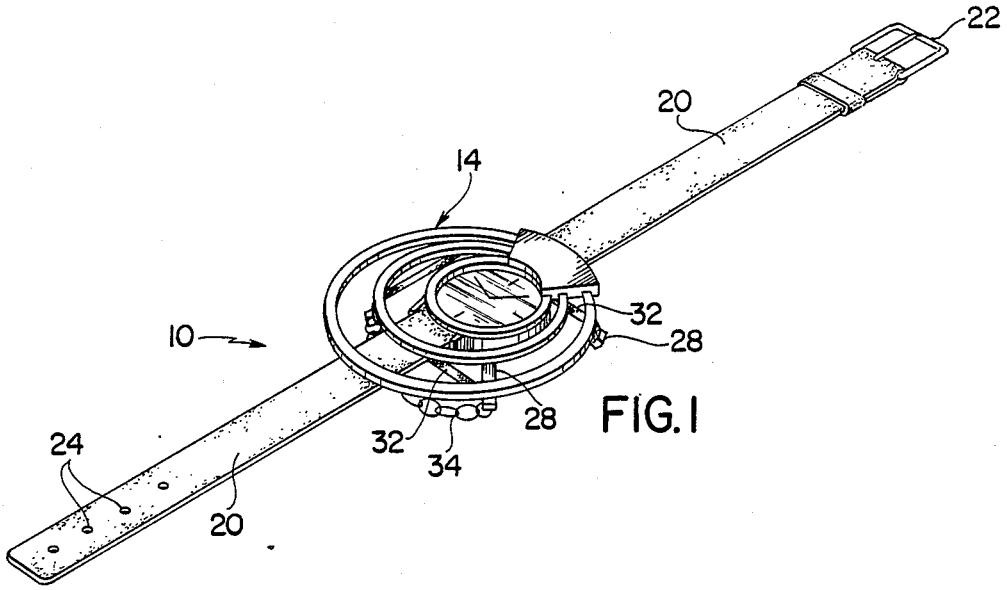
FIG. 1 is a perspective view of a wristwatch having the ornamental watch accessory of the present invention assembled therewith.
Figure 2:
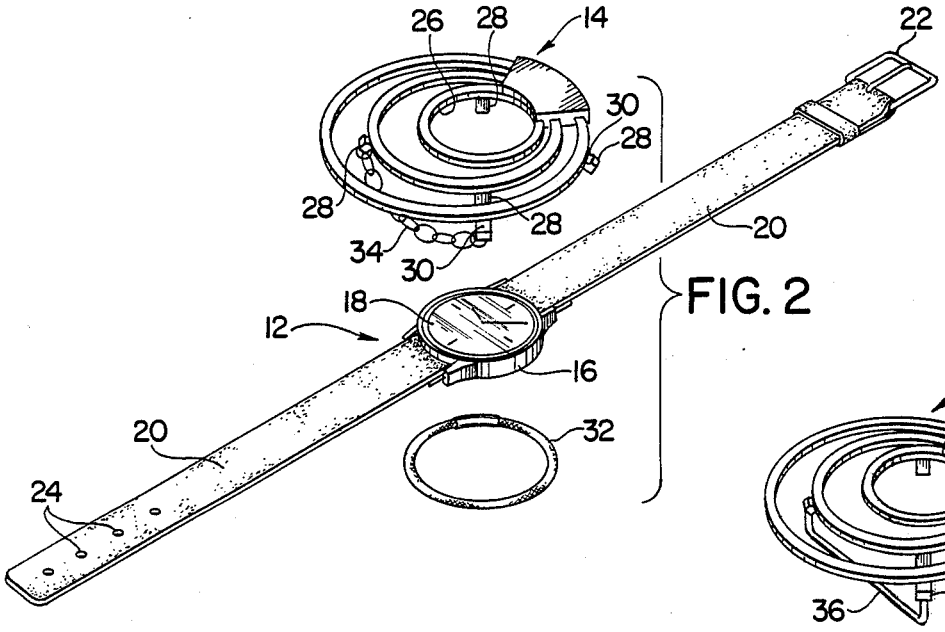
FIG. 2 is an exploded perspective view showing the wristwatch, the ornamental watch accessory, and the resilient band used when assembling the accessory to the watch.

Referring to the drawings, and more particularly FIGS. 1 and 2 thereof, there is shown at 10 a watch and accessory assembly comprising wristwatch 12 and ornamental accessory 14. The watch 12, which is conventional in all respects, comprises a watch housing 16 having a watch face 18 with a conventional strap or band 20 secured to opposite sides of housing 16 by any suitable means. The strap 20 has buckle 22 at one end thereof and perforations 24 at the opposite end, all as well known.

The ornament 14 may comprise any desired ornamentation, it being understood that the illustrated ornament is by way of example only. Whatever ornamental design is utilized, however, the ornament will comprise an opening 26 which aligns with watch face 18 when the ornament 14 is in assembled relation, so that the watch face may be visible through said opening. Ornament 14 may be cast of any desired metallic material, such as white metal, or it could even be molded of a durable plastic material.

The means for attaching accessory 14 to watch 12 will now be described. As will be seen most clearly in FIGS. 1 and 2, the ornament 14 has a plurality of posts 28 extending downwardly from the underside thereof, said posts having recessed portions 30 on their outer surfaces adjacent the ends thereof, the purpose of which will hereinafter become apparent. Preferably four such posts are provided, equally spaced from each other so as to define a generally square configuration, the distance between diagonally opposed posts being approximately $1\frac{1}{4}''$, this being the diameter or diagonal measurement of the largest watch housing in popular use. The ornament 14 is positioned over watch housing 18 so that opening 26 of the former is in alignment with watch face 18 and with the posts 28 spaced around the periphery of the watch housing. With the parts so oriented, a resilient band 32 is stretched around the posts, said band being received in the aforesaid recessed portions 30 whereupon the band resiliently clamps the ornamental accessory 14 to watch 12. If it is desired to remove the ornamental accessory 14 and perhaps place it with a different ornamental accessory, it is only necessary to grasp the band 32 and remove same from its position on the posts, whereupon the ornamental accessory is free to be lifted off of the watch.

Figure 3:
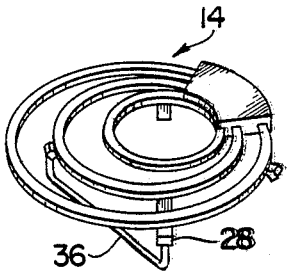
FIG. 3 is a perspective view of a slightly modified form of ornamental watch accessory.
Figure 4:
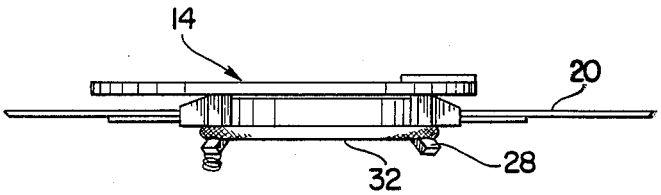
FIG. 4 is a side view of the watch and accessory assembly.

In case the band 32 should become inadvertently detached during handling or wear of the assembly 10, a retaining member 34 is provided, said retaining member, in the form illustrated in FIG. 2, comprising a flexible chain that is connected to and extends between an pair of adjacent posts 28, so long as said adjacent posts define the path through which the strap 20 extends. As will be seen most clearly in FIG. 4, the chain 34 is located beneath the strap 20, whereupon if resilient band 32 becomes inadvertently displaced, the chain 34 will at least temporarily retain the ornamental accessory 14 and watch 12 in assembled relation. Instead of the flexible chain 34 shown in FIGS. 2 and 4, it is feasible to also use a solid bar 36 extending between adjacent posts 28, as illustrated in FIG. 3. In either case, the only thing that is important is that the watch strap extend over chain 34 or bar 36 so that if resilient band 32 is inadvertently detached, the chain or bar will serve to temporarily retain the accessory 14 and watch 12 in interconnected relation.

Figure 5:
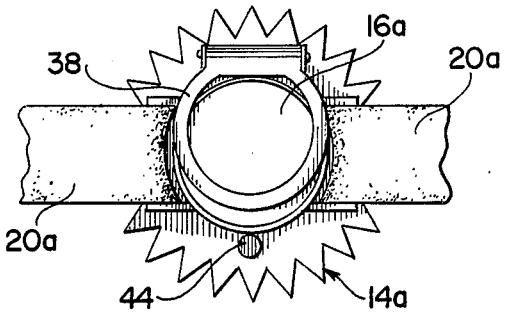
FIG. 5 is a bottom plan view of a modified watch and accessory assembly.
Figure 6:
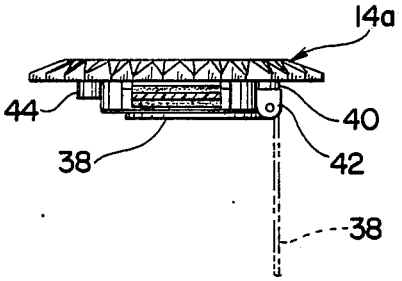
FIG. 6 is an end view of the assembly shown in FIG. 5.

FIGS. 5 and 6 show a modified form of the instant invention wherein the ornamental accessory 14*a* is releasably attached to watch housing 16*a* by means of a resilient clip 38 hingedly attached to bracket 40 as at 42, said hinge connection having spring means (not shown) which normally urge the clip 38 from the broken-line position illustrated in FIG. 6 to the full-line position therein wherein the ornamental accessory is clipped or clamped onto watch housing 16*a*. The ornament 14*a* is provided with a single downwardly extending post 44 oppositely disposed with respect to hinge connection 42, whereupon watch housing 16*a* is retained in position between bracket 40 and post 44. As will be noted, clip 38 extends perpendicularly with respect to the longitudinal axis of strap 20*a* in order to provide clearance for said strap, since otherwise the bracket 40 would interfere with the passage of said strap. It will be understood that in this form of our invention the ornamental accessory is positioned over the watch face so that the latter is in alignment with the opening in the former, the clip 38 being in its open position at this time. Once the parts have been properly oriented, with the clip 38 extending perpendicularly to the longitudinal axis of the watch strap, the clip is simply snapped to its closed position to complete the assembly.

Although our invention has heretofore been described as an ornamental accessory for watches, and although this is the primary utility of the invention, it is certainly within the scope of this invention to utilize the accessory 14 as an attachment to something other than a watch, such as, for example, a piece of jewelry comprising an ornamental stone or the like mounted in a setting wherein the stone and setting cooperate with the accessory in the same manner as the watch face and watch housing do.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A removable ornament for watches comprising a member adapted to be positioned on top of a watch housing, said member having an opening therein through which the watch face is visible when the ornament is operatively assembled to a watch, said member having an ornamental portion disposed outwardly of said opening, and means carried by said member for releasably attaching same to the watch housing so that the watch face and the opening in the member are in alignment, said attaching means comprising a plurality of posts extending from the underside of said member and adapted to be spaced around the periphery of said watch housing, and a resilient band extending around said posts in order to resiliently retain said member in assembled relation to the watch, said posts having recessed portions for receiving said resilient band, there being four of said posts equally spaced around the periphery of said watch housing, whereby the strap of the watch is adapted to extend between adjacent posts, and is clamped between the resilient band and the ornamental member.

2. In the ornament of claim 1, a retaining member extending between the said adjacent posts, whereby if the resilient band becomes inadvertently detached, said retaining member will at least temporarily keep the ornament and watch in interconnected relation.

3. In the ornament of claim 2, said retaining member being a flexible chain.

4. In the ornament of claim 2, said retaining member being a bar.

5. In combination, a watch comprising a watch housing having a watch face on the upper surface thereof, and a watch strap connected to opposite sides of said housing, the combination further comprising an ornamental member positioned on top of said watch housing, said member having an opening therein through which said watch face is visible, and means carried by said member releasably attaching same to said housing, said attaching means comprising a plurality of posts extending from the underside of said ornamental member and adapted to be spaced around the periphery of said watch housing, and a resilient band extending around said posts in order to resiliently retain said ornamental member in assembled relation to the watch.

6. In the combination of claim 5, said posts having recessed portions for receiving said resilient band.

7. In the combination of claim 6, there being four of said posts equally spaced around the periphery of said watch housing, whereby the strap of the watch is adapted to extend between adjacent posts, and is clamped between the resilient band and the ornamental member.

8. In the combination of claim 7, a retaining member extending between the said adjacent posts, whereby if the resilient band becomes inadvertently detached, said retaining member will at least temporarily keep the ornament and watch in interconnected relation.

9. In the combination of claim 8, said retaining member being a flexible chain.

10. In the combination of claim 8, said retaining member being a bar.

* * * * *